US008944891B2

(12) United States Patent
Junker

(10) Patent No.: US 8,944,891 B2
(45) Date of Patent: Feb. 3, 2015

(54) CENTRELESS CYLINDRICAL GRINDING MACHINE FOR GRINDING WORKPIECES IN ROD FORM AND METHOD FOR THE CENTRELESS CYLINDRICAL GRINDING OF WORKPIECES IN ROD FORM

(75) Inventor: Erwin Junker, Buehl/Baden (DE)

(73) Assignee: Erwin Junker Grinding Technology A.S., Melnik (CZ)

( * ) Notice: Subject to any disclaimer, the term of this patent is extended or adjusted under 35 U.S.C. 154(b) by 320 days.

(21) Appl. No.: 13/583,885

(22) PCT Filed: Mar. 7, 2011

(86) PCT No.: PCT/EP2011/053396

§ 371 (c)(1),
(2), (4) Date: Oct. 12, 2012

(87) PCT Pub. No.: WO2011/110529

PCT Pub. Date: Sep. 15, 2011

(65) Prior Publication Data

US 2013/0165022 A1 Jun. 27, 2013

(30) Foreign Application Priority Data

Mar. 9, 2010 (DE) ..... 10 2010 010 758

(51) Int. Cl.
*B24B 5/37* (2006.01)
*B24B 5/22* (2006.01)
*B24B 5/38* (2006.01)

(52) U.S. Cl.
CPC .... *B24B 5/22* (2013.01); *B24B 5/38* (2013.01)
USPC ..... 451/49; 451/245

(58) Field of Classification Search
USPC ..... 451/49, 245, 5, 242, 407
See application file for complete search history.

(56) References Cited

U.S. PATENT DOCUMENTS

| | | | | |
|---|---|---|---|---|
| 2,043,972 | A * | 6/1936 | Merryweather | 451/189 |
| 2,436,252 | A * | 2/1948 | Duncan | 451/49 |
| 2,939,253 | A | 6/1960 | Richard et al. | |
| 3,079,741 | A * | 3/1963 | Render | 451/49 |
| 4,194,323 | A * | 3/1980 | Blocker, Jr. | 451/28 |
| 4,841,682 | A * | 6/1989 | Waelti | 451/49 |

FOREIGN PATENT DOCUMENTS

| | | |
|---|---|---|
| DE | 478720 | 7/1929 |
| DE | 801500 | 1/1951 |
| DE | 101 00 871 | 6/2002 |
| GB | 431471 | 7/1935 |

* cited by examiner

*Primary Examiner* — Robert Rose
(74) *Attorney, Agent, or Firm* — Jordan and Hamburg LLP

(57) ABSTRACT

In a machine for centerless cylindrical grinding, the workpiece is located in a grinding gap, which is formed by the regulating wheel, the grinding wheel and the support blade. The regulating wheel rotates about its axis of rotation with the direction of rotation, and thereby drives the workpiece to rotate in the direction of rotation. The grinding wheel is driven to rotate about its axis of rotation with the direction of rotation. The workpiece passes in the direction of its longitudinal axis through a number of sets of regulating wheels and grinding wheels, which are each themselves arranged coaxially one behind the other. The regulating wheels and grinding wheels have axial interspaces on their axes; the regulating wheels thereby engage in the interspaces between the grinding wheels, and vice versa, so as to form lateral regions of overlap between the wheels.

20 Claims, 5 Drawing Sheets

CENTRELESS CYLINDRICAL GRINDING MACHINE FOR GRINDING WORKPIECES IN ROD FORM AND METHOD FOR THE CENTRELESS CYLINDRICAL GRINDING OF WORKPIECES IN ROD FORM

BACKGROUND OF THE INVENTION

The invention relates to a centerless cylindrical grinding machine for grinding workpieces in rod form with a cylindrical outer contour using the throughfeed grinding process having certain features. The invention also relates to a method for the centerless cylindrical grinding of workpieces in rod form having certain features. A cylindrical grinding machine and a method of this type are known from DE 101 00 871 C1. In the cylindrical grinding machine according to the prior art, two individual cylindrical grinding machines are combined as separate assemblies on a common base plate to form one unit. The rod-shaped or tubular workpiece runs continuously through the two separate grinding units for grinding one after another. Here, in every grinding unit, a comparatively wide cylindrical grinding wheel lies opposite an assembly of regulating wheels which are comparatively thin and are arranged at a spacing from one another on a common spindle. Together with the customary support blade, the grinding and regulating wheels are situated in a common axial region; the two assemblies are also independent of one another in every regard. For example, the grinding geometry, that is to say the spatial assignment of grinding wheel, regulating wheel and support blade in relation to the workpiece, can be different in each of the two units.

In the known cylindrical grinding machine, two grinding gaps are therefore formed which are situated at an axial spacing from one another and through which the rod-shaped or tubular workpiece runs. The two units of the known cylindrical grinding machine can serve different tasks; for example, the rough grinding can take place in the first unit, whereas the finishing is performed in the second unit. However, the finishing can also already be started in the first unit, with the result that more machining time is available overall for the process of finishing. As a result, the tool wear can be reduced considerably during rough grinding with a relatively low erosion rate. In both units of the known grinding machine, the workpiece is arranged in the grinding gap in such a way that it is situated "below the middle". The following is therefore meant in an exact definition: the workpiece is fixed in the radial direction in the widening grinding gap in accordance with a reference plane which is placed through the rotational and drive axes of regulating wheel and grinding wheel; here, the workpiece longitudinal axis is situated such that it is moved away from said reference plane within a part region of the grinding gap between said reference plane and the supporting face of the work rest blade. This arrangement has the advantage that the workpiece is clamped in a certain way in the grinding gap between the regulating and grinding wheel on one side and the supporting face of the work rest blade on the other side. It therefore also cannot be ejected out of the grinding gap when machining is carried out with relatively great grinding forces. The cylindrical grinding can therefore be carried out "below the middle" with a high material removal rate, and the axial advancing of the workpiece in the grinding section and in the grinding gap can be high.

The arrangement "below the middle" is therefore preferred in many applications in centerless cylindrical grinding. The limits of the arrangement are shown, however, when rod-shaped or tubular workpieces are to be ground which have a small diameter. The workpiece then has to bear against the grinding and regulating wheel in a region of the grinding gap, in which the outer contours of the wheels already merge into an approximately parallel profile. The workpiece therefore lies very far to the top in the grinding gap, with the result that it can migrate upward out of the grinding gap in the worst case. It at least becomes more and more difficult to ensure a secure and steady position of the workpiece during grinding by way of the usual support blade. If the grinding gap becomes narrower and narrower, finally the region is approached, in which the grinding wheels would abut one another; centerless cylindrical grinding of workpieces with a small diameter is then no longer possible in the conventional way.

German patent specification 801 500 has disclosed a special device which is to be actuated by hand and by way of which two lateral grinding points are to be machined on a workpiece at the same time by centerless cylindrical grinding. To this end, two grinding wheels are arranged in a floating manner on a common shaft and are driven rotationally; their axial spacing from one another is variable. In order to grind the lateral grinding points, one movably arranged grinding wheel is moved in axially from the outside toward the second stationary grinding wheel. During the grinding of the lateral grinding points, the two grinding wheels remain at an axial spacing from one another. A regulating wheel for driving the workpiece is arranged opposite on the other side of the workpiece. The regulating wheel and the grinding wheel are offset with respect to one another because, in its axial position, the regulating wheel is situated where the gap between the two grinding wheels exists on the opposite side of the workpiece. In each case only one single workpiece is to be ground by way of the known apparatus, which workpiece has to be introduced into the apparatus and removed from it again for this purpose. The workpiece has approximately the shape of a spindle, as is present in the hubs of bicycles.

In a centerless cylindrical grinding machine which is known from DE 478 720 A, long, thin round rods are to be ground and transported using the throughfeed grinding process by three separate groups of wheels. Each of the three groups comprises a common spindle which is driven rotationally and on which the wheels of said group are situated at a mutual axial spacing. The three groups extend along the round rod to be ground and enclose the latter between them. Here, the first group consists of grinding wheels; the associated spindle extends parallel to the axis of the round rod. The spindle of the second group is inclined slightly with respect to the axis of the round rod; the wheels which are arranged on said spindle are guide wheels with a conical edge which is fitted with felt. The guide wheels bring about the transport of the round rod in the axial direction. The grinding wheels and guide wheels lie opposite one another at a radial spacing in the customary way, to be precise such that exactly one guide wheel lies opposite each grinding wheel.

The third group of wheels in the cylindrical grinding machine according to DE 478 720 A is arranged below the round rod which is running through, on a common spindle in such a way that said wheels engage from below into the axial intermediate spaces between the grinding wheels and the guide wheels and support the round rod. The known machine has no support blade. Rather, the wheels of the third group act in a similar manner to a support blade; in addition, they bring about the rotary drive of the round rod. The known machine according to DE 478 720 A should make the utilization of different-grained grinding wheels possible and at the same time ensure vigorous spinning of the workpieces with powerful axial advancing.

SUMMARY OF THE INVENTION

In contrast, the invention is based on the object of improving the cylindrical grinding machine and the cylindrical grinding method of the type stated at the outset, in such a way that even rod-shaved or tubular workpieces of small external diameter are held in a reliably stable and steady manner in the grinding gap which is formed by the grinding wheels, the regulating wheels and the support blade, with the result that a satisfactory grinding result is achieved even during grinding with a high material removal volume.

This object is achieved in the cylindrical grinding machine and the cylindrical grinding method of the invention.

In the centerless cylindrical grinding machine according to the invention, it is therefore provided that the regulating and grinding wheels are arranged offset in the axial direction with respect to one another, the regulating wheels projecting into the axial intermediate spaces between the grinding wheels and, conversely, the grinding wheels also projecting into the axial intermediate spaces between the regulating wheels. The regulating and grinding wheels can therefore no longer come into contact with one another, and the grinding gap does not already begin in the abovementioned reference plane, but rather at a distance from the latter in a region, in which the spacing between the outer contours of grinding and regulating wheel is enlarged increasingly. The workpiece therefore bears against the grinding and regulating wheel on two tangential contact lines which extend in its longitudinal direction, said contact lines being at a relatively great spacing from one another. A person skilled in the art calls this a "great below-middle extent". As a result, the position of the workpiece in the grinding gap remains reliably steady and stable even when work is carried out with a high material removal volume.

It is possible by way of the cylindrical grinding machine according to the invention to allow the grinding wheel to run at the contact point with the workpiece in the same direction as the surface of the latter or in the opposite direction thereto. Independently of this, the rotational direction of the grinding wheel can also be selected in such a way that, at the point of its contact with the workpiece, the grinding wheel circumference moves toward the reference plane, that is to say into the grinding gap. This has the advantage that, during grinding, the workpiece is pressed more powerfully against the regulating wheels and therefore the work rest blade is relieved. The wear of the work rest blade is therefore reduced.

One advantageous development of the cylindrical grinding machine according to the invention consists in the fact that the basic pattern of the multiple set comprises in each case one row of two or more wheels, of which one row with regulating wheels is arranged on one side of the workpiece and the other row with grinding wheels is arranged so as to lie opposite on the other side of the workpiece. In comparison with the known cylindrical grinding machine which was mentioned at the outset and is expressly fixed to two grinding units which are independent of one another, this therefore results in a comparatively simple basic construction, in which three and more regulating and grinding wheels can also be driven jointly one behind another in the axial direction.

Here, in every section of the grinding gap, the grinding and regulating wheels are then driven in a constant rotational direction; here, the rotational speed of the regulating wheels firstly and of the grinding wheels secondly can be set independently, as can the two-sided setting of the wheels against the workpiece, it goes without saying that it is also possible via the machine controller to adapt the rotational speeds and the setting movement of the two wheel groups to one another in a controlled manner.

In addition to these considerations, it can be provided, according to further advantageous embodiment, that the regulating wheels and the grinding wheels have diameters which increase in a stepped manner in the axial throughfeed direction of the workpiece and, in this case, the work rest blade is also adapted with its supporting face to the diameter of the workpiece, which diameter decreases in its longitudinal direction, in this embodiment, during running grinding operation, no further setting movement of the regulating and grinding wheels is performed. Rather, the radial setting during the grinding via the wheels has been made superfluous by virtue of the fact that the rod-shaped workpiece runs through wheel groups with an increasing diameter, the grinding gap becoming narrower and narrower. A change in the setting required only when the grinding wheels have to be changed or when a change to workpieces with a different diameter to previously takes place.

In the cylindrical grinding machine according to the invention, the regulating and grinding wheels are no longer immediately opposite one another in the transverse direction. The offset arrangement of the wheels means that there is the risk of deflection, if small, for the workpiece. In the worst case, the grinding result could be impaired as a result. Therefore, according to a further advantageous embodiment, it is provided preventatively that the lateral overlap regions of the regulating and grinding wheels are separated from one another by axial gaps, the width of which is only so great that the regulating and grinding wheels do not mutually impair their function or even make contact, even during continuous production operation. The correct dimensioning of the gap width is the result of simple operational tests; a guide value for practice can be, for example, the range between 0.5 and 2 mm.

A further advantageous measure for avoiding bending loads in the workpiece consists in the fact that the axial width of the grinding wheels is smaller than the axial width of the regulating wheels.

It is essential for the operation of the cylindrical grinding machine according to the invention that the grinding wheels have a long service life. Only then can grinding be carried out with a high material removal volume, without subsequent correcting of the setting being required during grinding operation. CBN grinding wheels, the CBN grinding lining of which can be coated galvanically and can be ceramically bonded or metal-bonded, are therefore preferred for the cylindrical grinding machine according to the invention.

The high load capacity of the workpieces in the cylindrical grinding machine which is designed according to the invention also means that regulating wheels made from steel can be used. They should advantageously be provided on their outer circumference with a thread profile which, in a similar manner to a conveying worm, exerts an axial thrust on the workpiece in the direction of the throughfeed direction, in which the workpiece runs through the grinding gap. Here, the outer circumference of the regulating wheel or the thread profile should advantageously be configured as a friction lining which is composed of a different material than steel, preferably of a galvanically bonded CBN layer.

Further advantageous refinements relate to the guidance of the rod-shaped workpiece in the grinding section and to the drive of the workpiece in its longitudinal and movement direction, that is to say the throughfeed direction in the grinding section.

For instance, an inlet support wheel with an elastic circumferential covering can be arranged at the inlet E of the multiple set in the row of the regulating wheels, in front of the latter, which inlet support wheel, together with the regulating wheels, is fastened on the regulating wheel spindle and is driven rotationally by the latter. Said inlet support wheel can compensate for a lateral deviation of the workpiece if the latter enters the grinding section with its front end as an out-of-round raw rod. Even the out-of-round workpiece is then introduced reliably into the grinding gap.

In a similar way, an outlet support wheel made from steel can be mounted freely rotatably on the grinding wheel spindle at the outlet A of the multiple set in the row of the grinding wheels, behind the latter. It is the object of the outlet support wheel to compensate for the forces which act on the rod-shaped workpiece at the outlet A of the grinding section. The aim here is also to prevent bending forces and a deflection of the workpiece at its end. A grinding wheel as final wheel would exert too high a lateral force on the workpiece and deflect the latter laterally. It would be similar with a driven regulating wheel as final wheel. The arrangement of an outlet support wheel made from steel is expedient, in particular, when galvanically coated CBN grinding wheels are used. In the case of the latter, their diameter changes only to a very small extent during their use; the effect of the outlet support wheel remains virtually unchanged as a result.

A further advantageous refinement of the outlet support wheel is that it is provided with a thin damping lining on the steel basic body, which lining firstly has a damping action on the finally ground workpiece during the exit from the grinding gap. The running smoothness of the workpiece out of the grinding gap can therefore be improved further (and therefore also the surfaces, measuring and dimensional accuracy on the workpiece). As a further advantage, the thin damping lining can also absorb small diameter changes of the grinding wheel.

The action of the inlet support wheel can be assisted further by virtue of the fact that a device for precentering the rod-shaped workpiece which is running through is arranged in front of the multiple set. Said device can comprise a supporting prism and a pressure roller which is assigned to the latter, the workpiece running through between the supporting prism and the pressure roller. The device for precentering therefore facilitates the first entry of the workpiece into the grinding section.

Finally, it can also be provided in an advantageous way that a device is provided at the start of the workpiece movement path, which device imparts a forward thrust to the workpiece in its longitudinal and movement direction. The forward thrust action of said additional device then takes place together with the effect of the thread profile on the outer circumference of the regulating wheels. The effect of both devices has to be adapted to one another in an expedient way.

The method according to the invention advantageously achieves a situation where continuous radial feeding of the grinding and/or regulating wheels against the workpiece during grinding operation is no longer required. Rather, the grinding and regulating wheels remain unchanged in their radial position with respect to the workpiece; instead, the workpiece runs continuously through the grinding gaps, formed one behind another, of regulating and grinding wheels, the spacing of which from one another becomes smaller and smaller in a stepped manner from the inlet E toward the outlet A of the grinding section, in accordance with the grinding progress. This reduction is brought about by the fact that the diameters of the regulating and grinding wheels become greater in a stepped manner toward the outlet of the grinding section.

The method according to the invention advantageously achieves a situation where continuous radial feeding of the grinding and/or regulating wheels against the workpiece during grinding operation is no longer required. Rather, the grinding and regulating wheels remain unchanged in their radial position with respect to the workpiece; instead, the workpiece runs continuously through the grinding gaps, formed one behind another, of regulating and grinding wheels, the spacing of which from one another becomes smaller and smaller in a stepped manner from the inlet E toward the outlet A of the grinding section, in accordance with the grinding progress. This reduction is brought about by the fact that the diameters of the regulating and grinding wheels become greater in a stepped manner toward the outlet of the grinding section. The radial setting movement of the regulating and grinding wheels during running grinding operation is therefore replaced by the movement of the rod-shaped workpiece in its longitudinal direction.

One advantageous development of the method according to the invention consists in the fact that the movement direction of the grinding wheel circumference, at the point of its contact with the workpiece, extends in the direction of the reference plane. In this procedure, the grinding wheel exerts an action of force on the workpiece which is pressed against the regulating wheel as a result. As a result, the loading of the work rest blade by the workpiece is reduced, as is therefore also the wear of the work rest blade.

Finally, it is also noted that the expression of the "rod-shaped workpieces" is also to include tubes. The rods or tubes which come into consideration here are intended to have a length of, for example, 6 meters. They are intended to be ground in the cylindrical grinding machine which is configured according to the invention, from the raw rod as far as a completely finished ground rod with a small diameter tolerance. Here, a high material removal rate can be achieved in a secured process with as low a workpiece rotational speed as possible. In the view from above, the longitudinal and rotational axes of the regulating wheels, the grinding wheels and the workpiece extend parallel to one another; the same also applies to the longitudinal extent of the work rest blade. In a view from the side, the longitudinal axis of the work rest blade can also extend in a slightly inclined manner with respect to the longitudinal axis of the workpiece, in accordance with the decrease in diameter of the workpiece.

In the following text, the invention will be explained in yet further detail using one exemplary embodiment which is shown in the figures. In the drawings:

DETAILED DESCRIPTION OF THE INVENTION

Figure 1:
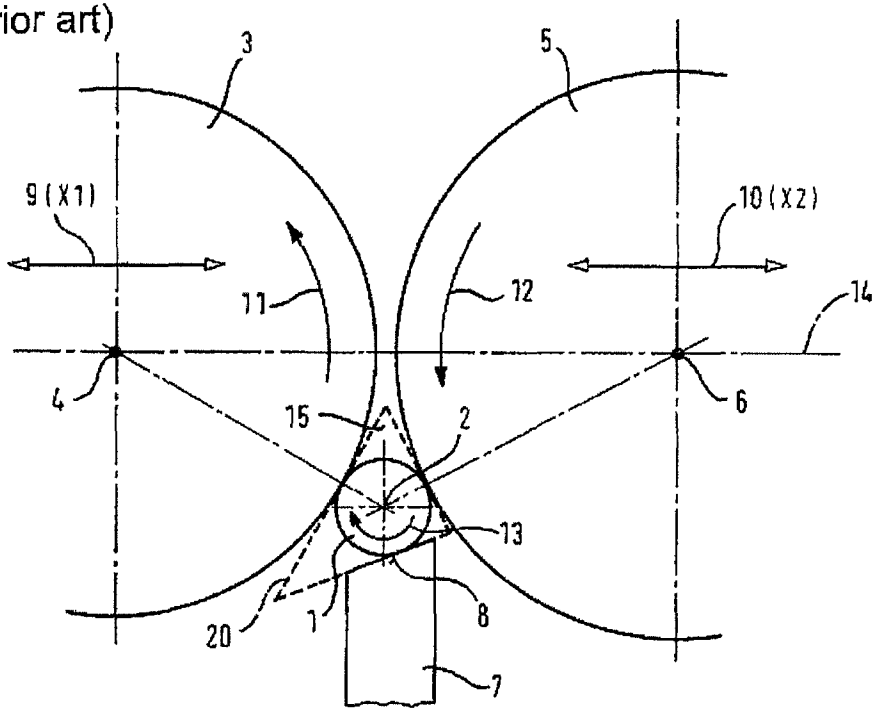
Fig. 1 (Prior art)
FIG. 1 shows an illustration of the grinding "below the middle" according to the prior art.

FIG. 1 diagrammatically shows the operation of centerless cylindrical grinding in an apparatus according to the prior art.

Here, in a throughfeed grinding process, the rod-shaped workpiece 2 moves in the direction of its longitudinal axis 2, that is to say perpendicularly with respect to the plane of the drawing, through a grinding section which is formed by regulating wheels 3, grinding wheels 5 and the work rest blade 7. Here, in the case of the known apparatus, two pairs of regulating and grinding wheels 3, 4 are arranged one behind another in the direction of the workpiece longitudinal axis 2. During the grinding operation, the regulating wheels 3 rotate about their rotational axes 4 and are set against the workpiece 1 in the setting direction 9 (X1 axis), which workpiece 1 is driven rotationally as a result about its longitudinal axis 2, cf. also the rotational direction arrows 12 and 13 in this regard. The grinding wheels 5 are likewise driven rotationally about their rotational axes 6 and bring about the cylindrical grinding during setting in their setting direction 10 (X2 axis). Here, the rod-shaped workpiece 1 rests on the supporting face 8 of the work rest blade 7.

According to FIG. 1, the regulating wheel 3 and the grinding wheel 5 form a grinding gap 15 which widens to the bottom and is closed at the bottom by the work rest blade 7 to such an extent that the rod-shaped workpiece 1 is enclosed and held firmly by linear contact with the regulating wheel 3, the grinding wheel 5 and the supporting face 8 of the work rest blade 7. The grinding result depends to a pronounced extent on the reliable guidance and as steady a position of the workpiece 1 as possible despite its rotation and despite the grinding operation; this applies, in particular, to the dimensional accuracy, roundness and surface quality which can be achieved. Here, it is also to be taken into consideration that the diameter of the workpiece 1 changes continuously during the grinding.

The arrangement, shown in FIG. 1, of the workpiece 1 in the grinding gap 15 is denoted in practice as an "arrangement below the middle". This means that the workpiece 1 is situated in the grinding gap 15 below a reference plane 14 which extends through the rotational axes 4, 6 of regulating and grinding wheel 3, 5, and that the supporting face 8 of the work rest blade 7 is also situated below said reference plane 14. However, the simple designation "below middle" applies only when the rotational axes 4, 6 lie jointly in an at least approximately horizontal plane. For a different assignment of the rotational axes 4, 6, it will have to be formulated somewhat more abstractly that the position of the workpiece 1 is fixed in the radial direction in the grinding gap 15 which is formed by the regulating and grinding wheels 3, 5, in accordance with a reference plane 14 which is placed through the rotational and drive axes 4, 6 of the grinding and regulating wheels 3, 5, the workpiece longitudinal axis 2 having to be situated such that it is moved away from said reference plane 14 within a widening part region of said grinding gap 15 between the reference plane 14 and the supporting face 8 of the work rest blade 7. The same situation is therefore meant, as is denoted in simplified form by "arrangement below middle" for the stated special case.

In the arrangement which is shown in FIG. 1, the rod-shaped workpiece 1 cannot migrate in the grinding gap 15 or exit it because it would have to migrate upward into the narrowing grinding gap 15 and is blocked downward by the work rest blade 7. The workpiece 1 is effectively "clamped" in the grinding gap 15. Work can therefore be carried out using great forces during driving and grinding of the workpiece 1. The favorable force conditions permit the use of regulating wheels 3 made from steel, without there being the risk of sliding and slipping.

However, FIG. 1 also shows the limits of the known apparatuses if the workpiece 1 is to be arranged in the grinding gap 15 between the reference plane 14 and the supporting face 8 of the work rest blade 7 during the centerless cylindrical grinding. In particular, workpieces 1 of relatively small starting diameter then move closer and closer to the reference plane 14 and are then situated in a region of the grinding gap 15, in which the circumferential faces of regulating and grinding wheel 3, 5 approach a course perpendicularly with respect to the reference plane 14. As a result, the guidance of the workpiece 1 in the grinding gap 15 becomes unstable, and it is no longer ruled out that the workpiece 1 will slide out upward over the reference plane 14. Finally, a further narrowing of the grinding gap 15 is no longer possible because the regulating and grinding wheels 3, 5 would then make contact with one another.

Figure 2:
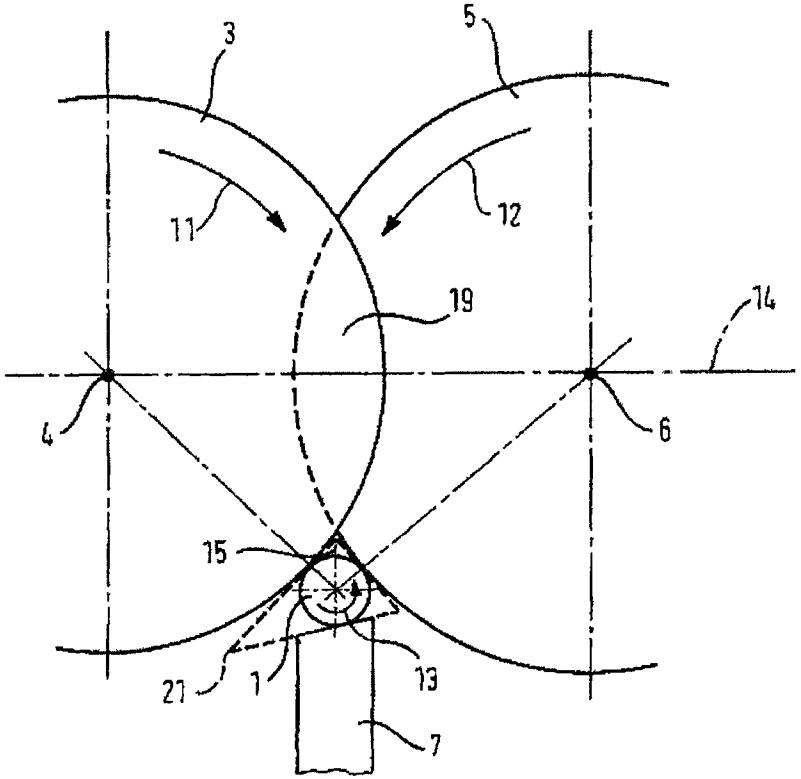
FIG. 2 shows the procedure according to the invention.
Figure 2A:
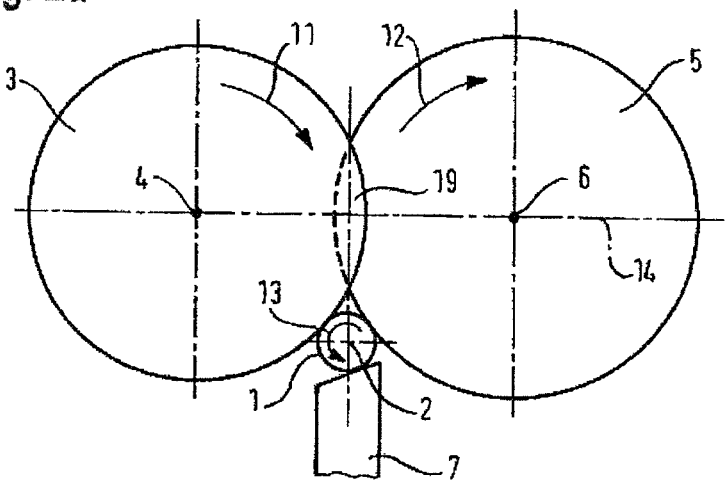
FIG. 2*a* shows the function of the apparatus according to FIG. 2 with an opposite rotational direction of the grinding wheel.
Figure 3:
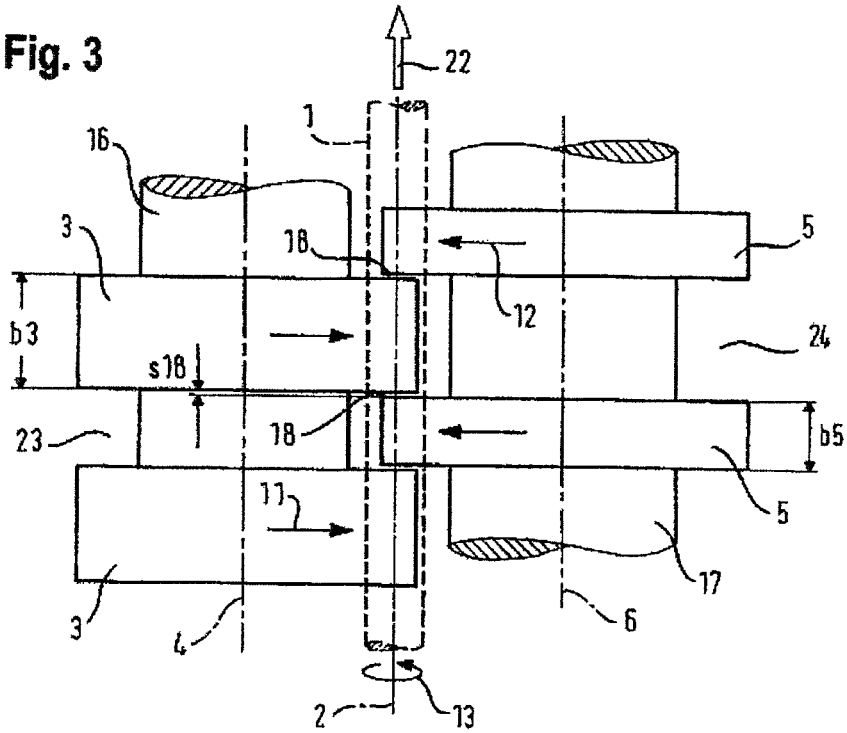
FIG. 3 shows a part view, belonging to FIG. 2, from above of an apparatus according to the invention, FIG. 4 serves to explain the procedure in an apparatus according to the invention, the illustration being diagrammatic and not showing the actual assignment of the individual parts with respect to one another, FIGS. 5*a* and 5*b* explain details of a regulating wheel.

Enhanced machining options result from the design which is shown in FIGS. 2, 2*a* and 3. Here, FIG. 2*a* corresponds to the front view according to FIG. 2, and FIG. 3 is the detail from a view from above of the decisive functional parts of a cylindrical grinding machine which is configured according to the invention. The regulating wheels 3 are arranged on a common regulating wheel spindle 16 and the grinding wheels 5 are arranged on a common grinding wheel spindle 17. Axial intermediate spaces 23, 24 are situated between the individual regulating and grinding wheels 3, 5. As FIG. 3 shows particularly clearly, the regulating wheel spindle 16 and the grinding wheel spindle 17 are arranged so as to extend in parallel with a small spacing, with the result that the individual regulating wheels 3 engage into the axial intermediate spaces 24 between the grinding wheels 5 and, vice versa, the grinding wheels 5 engage into the axial intermediate spaces 23 which are present between the regulating wheels 3.

All the regulating wheels 3 are set jointly in rotation via the regulating wheel spindle 16; all the grinding wheels 5 are likewise set jointly in rotation via the common grinding wheel spindle 17.

The workpiece 1 which is shown using dashed lines in FIG. 3 and lies below the regulating and grinding wheels 3, 5 is set in rotation and ground as a result, said workpiece 1 running through the grinding gap 15 and therefore through the grinding section in the axial throughfeed direction 22.

The advantages of the amended arrangement can be seen immediately from FIG. 2. The mutual engagement into one another of the regulating and grinding wheels 3, 5 leads to lateral overlap regions 19, with the consequence that the widening grinding gap 15 does not begin as early as in the reference plane 14, but rather begins at a substantially lower point. The workpiece 1 therefore bears against circumferential faces of the regulating and grinding wheels 3, 5 which extend in a substantially flatter manner than in FIG. 1, although the workpiece 1 in FIG. 2 has a smaller diameter than in FIG. 1.

In order to clarify this situation, FIGS. 1 and 2 in each case show an enclosure triangle 20 and 21, the sides of which are formed from the contact tangents of the workpiece 1 with the regulating and grinding wheel 3, 5 and from the supporting face 8 of the work rest blade 7. The upper angle of the tip which projects into the grinding gap 15 is substantially greater in the enclosure triangle 21 of the cylindrical grinding machine according to the invention than in the enclosure triangle 20 according to the prior art. The workpiece 1 with the small diameter is therefore evidently held in a reliably stable and steady manner; an operating mode therefore becomes possible, in which the workpiece 1 rotates with the same rotational direction 13 about its longitudinal axis 2 as the grinding wheels 5 about the rotational axes 6, which results in a circumferential movement in opposite directions at the mutual engagement points, cf. in this regard the rotational direction arrows 12 and 13. The operating mode with an opposed rotational direction is likewise just as possible, cf. FIG. 2*a*. The stable "clamping" of the workpiece 1 in the grinding gap 15 provides the precondition for machining using CBN grinding wheels 5 which achieve a high material removal volume.

FIG. 2*a* otherwise also shows a further essential detail. As is apparent there from the rotational direction 12 of the grinding wheel 5, the circumference of the grinding wheel 5 moves into the grinding gap at its contact point with the workpiece 2, that is to say toward the reference plane 14. The grinding wheel 5 therefore exerts an action of force on the workpiece 1, which action of force leads to additional pressure of the workpiece on the regulating wheel 3. As a result, the force is reduced, with which the workpiece presses onto the supporting face 8 of the work rest blade 7. As a result, this leads to the wear of the work rest blade being reduced.

The mutually offset arrangement in the axial direction of the regulating and grinding wheels 3, 5 means for the workpiece 1 that there is the risk of a deflection, even if said deflection is small, which might impair the grinding result in the worst case. This is counteracted firstly by the fact that the diameters of the regulating wheel and grinding wheel spindles 16, 17 are dimensioned to be comparatively great. Secondly, the axial width b3 of the regulating wheels 3 is configured to be greater than the axial width b5 of the grinding wheels 5, in order that the high setting force of the grinding wheels 5 which acts in the radial direction during the grinding can be absorbed reliably by the regulating wheels 3.

In the attempt to keep bending forces away from the workpiece 1, the width s18 of the axial gap 18 also has to be kept as small as possible, which axial gap 18 exists in the lateral overlap regions 19 between the regulating wheels 3 and the grinding wheels 5. A generally valid regulation cannot be drawn up for this; however, it can be determined reliably by way of tests without relatively great outlay how small the gap width s18 can be, without the regulating and grinding wheels 3, 5 themselves impairing their function mutually in continuous production operation or even making contact with one another. A guide value for practice can be, for example, the range between 0.5 and 2 mm.

Figure 4:
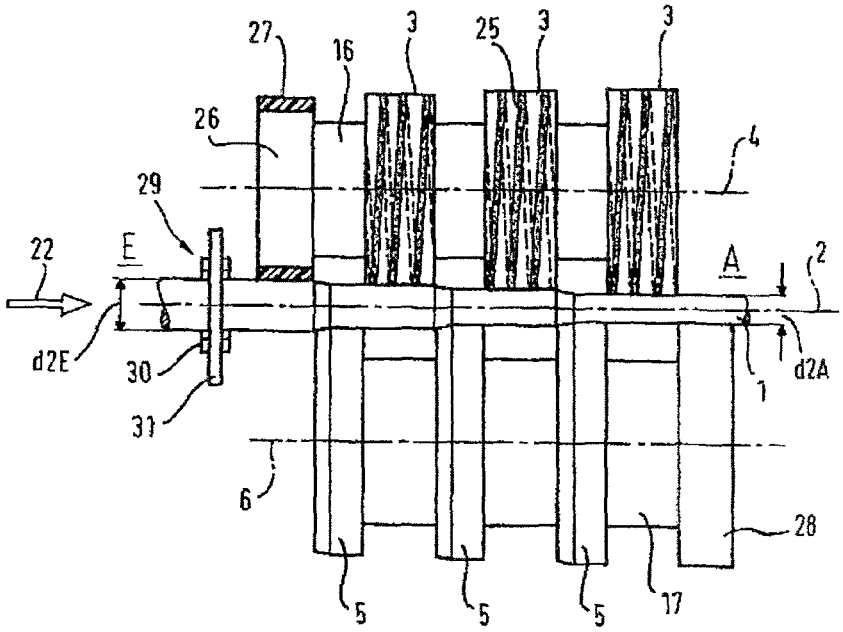

FIG. 4 shows the diagram of a cylindrical grinding machine according to the invention, in which a row of three regulating wheels 3 interacts with a row of three grinding wheels 5. Here, the illustration of FIG. 4 does not correspond to the actual arrangement of the regulating and grinding wheels 3, 5. For the improved comprehension of the function, an illustration has rather been selected which corresponds to a sectional line in FIG. 2 through the rotational axis 4 of the regulating wheel 3, the longitudinal and rotational axis 2 of the workpiece 1 and the rotational axis 6 of the grinding wheel 5. Here, the three stated rotational axes 4, 2 and 6 then lie on a common straight line, and FIG. 4 clarifies the interaction of the wheels 3, 5 with the workpiece 2.

A device which imparts an advancing movement to the rod-shaped workpiece 1 in its longitudinal and throughfeed direction 2 and 22 can be set upstream of the grinding section which is shown in FIG. 4. Since devices of this type belong to the prior art, they do not need to be shown in greater detail here. The external diameter of the grinding wheels 5 which are arranged on the common grinding wheel spindle 17 increases in a stepped manner in the order from the inlet E to the outlet A of the grinding section; the same applies to the regulating wheels 3 which are arranged on the common regulating wheel spindle 16. Since the regulating and grinding wheels 3, 5 are set jointly via their common spindles 16, 17, a grinding gap 15 is formed which becomes narrower in a stepped manner from the inlet E to the outlet A of the grinding section. By the rod-shaped workpiece 1 running continuously through the grinding gap 15 (cf. FIG. 2) in the case of wheels 3, 5 which are set, said rod-shaped workpiece 1 is ground cylindrically, its diameter decreasing from a value d2E at the inlet E of the grinding section to a value d2A at the outlet A of the grinding section.

The support blade 7 has to be adapted to this decrease in the workpiece diameter. To this end, said support blade 7 can be set obliquely over the entire length of the grinding section or can consist of individual adapted sections which in each case project a bit further into the grinding channel 15 step by step in the throughfeed direction 22. The decrease in the workpiece diameter is shown on a greatly exaggerated scale in FIG. 4, in order that the functional principle can be seen clearly.

Figure 5A:
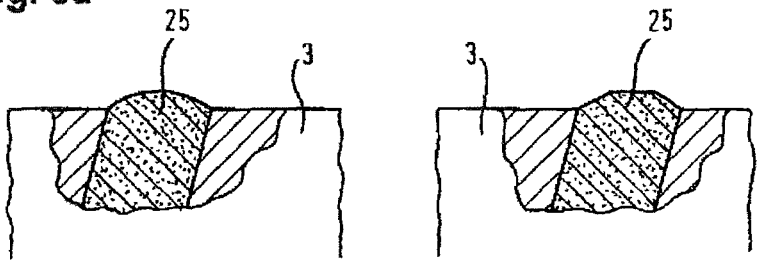
Figure 5B:
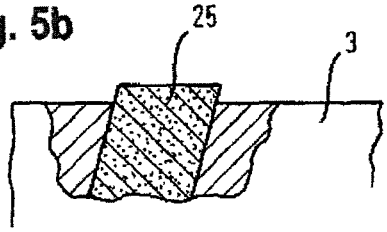

The grinding wheels 5 are galvanically coated, ceramically bonded or metal-bonded CBN grinding wheels which are preferred on account of their high material removal performance and their stability. The regulating wheels 3 have a basic body made from steel and are provided on their outer circumference with a friction lining which can consist of a galvanically bound CBN layer. Here, the friction lining is expediently configured as a thread profile 25, cf. FIG. 5. Here, the outer contour of the thread profile 25 can be curved (FIG. 5*a*) or rectilinear (FIG. 5*b*). The shapes illustrated in FIG. 5*a* of the curved contour of the thread form firstly show, on the left-hand side, a convex shape "assembled from round shaped elements". The second embodiment on the right is assembled from straight elements. However, mixtures of the individual formats are also conceivable. The regulating wheels 3 which are equipped in this way then exert, in a similar manner to a conveying worm, an axial thrust on the rod-shaped workpiece 1 in the throughfeed direction 22. They can therefore assist or even replace the abovementioned advancing device which is set upstream of the inlet E of the grinding section. Moreover, it is possible to influence the conveying speed of the workpiece 1 in the grinding gap 15 in a targeted manner via the thread lead of the thread profile 25 in conjunction with the rotational speed of the regulating wheels 3. Finally, a thread profile 25 made from a CBN friction lining can also receive contaminants on the workpiece 1 to a certain extent because the CBN grain projects beyond the lining.

Figure 6:
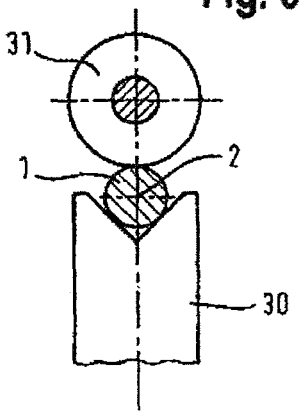
FIG. 6 shows a detail on the inlet side of the apparatus according to the invention.

A further device 29 is arranged at the inlet E of the grinding section, which further device 29 consists of a supporting prism 30 and a pressure roller 31, between which the rod-shaped workplace 1 runs through, cf. FIG. 6. By way of the device 29, the rod-shaped workpiece 1 is precentered and is introduced into the grinding gap 15 in a stable manner. As a result, targeted initial grinding of the workplace 1 takes place, and the tendency to chattering during initial grinding is suppressed.

When the rod-shaped workpiece 1 has passed the device 29 for precentering, it next passes into the action region of an inlet support wheel 26. The latter is mounted fixedly on the regulating wheel spindle 16 so as to rotate with it, is set upstream of the regulating wheels 3 and is driven rotationally together with the latter. The inlet support wheel 26 is provided with an elastic circumferential covering 27 and can compensate for the lateral deviation of an out-of-round workpiece 1 when the latter enters the grinding section with its front end as a raw rod. In this way, the out-of-round workplace 1 is also introduced reliably into the grinding gap 15.

An outlet support wheel 28 is provided at the outlet A of the grinding section on the side of the grinding wheels 5. Said outlet support wheel 28 is mounted freely rotatably on the grinding wheel spindle 17, and is therefore not driven together with the grinding wheels 5. The outlet support wheel 28 can be composed of steel and is given its rotary drive by contact with the workpiece 1; it does not have a thread profile on its circumference. The task of the outlet support wheel 28 consists in compensating for the forces which act on the rod-shaped workpiece 1 at the outlet A of the grinding section. A grinding wheel 5 as final wheel would exert too high a lateral force on the workpiece 1 and deflect the latter laterally. It would be similar with a driven regulating wheel 3 as final wheel. The arrangement of an outlet support wheel 28 made from steel is particularly expedient in the case of the use of CBN grinding wheels; this is because, in the case of the latter, the diameter reduces only to a very small extent during their useful life; the action of the outlet support wheel 28 then remains virtually unchanged.

A regulating wheel support (not shown) brings about the radial setting of the regulating wheel spindle 16 with all of its regulating wheels 3 and the inlet support wheel 26 against the workplace; a grinding wheel support (not shown) likewise serves for the radial setting of the grinding wheel spindle 17 with all its grinding wheels 5. During grinding operation, the position of the regulating and grinding wheels 3, 5 radially with respect to the workpiece 1 does not have to be changed, or only has to be changed insignificantly, because the diameter of the CBN grinding wheels 5 remains virtually unchanged during their useful life. Renewed setting becomes necessary only during the change of the grinding wheels 5 or if a change takes place to workpieces having a different diameter. Continuous adjustment of grinding and regulating wheel 3, 5 in accordance with the decreasing workpiece diameter is not necessary in any case in the throughfeed grinding process, because the rod-shaped workpiece 1 instead migrates through a grinding gap 15 which gets narrower in a stepped manner.

The invention claimed is:

1. A centerless cylindrical grinding machine for grinding a workpiece in rod form with a cylindrical outer contour using a throughfeed grinding process, the machine comprising:

at least one set of regulating wheels and at least one set of grinding wheels arranged at opposite sides of the workpiece and each set having a rotational axis parallel to a longitudinal axis of the workpiece;

the regulating and grinding wheels thereby being arranged to drive and grind the workpiece while the workpiece runs between the regulating and grinding wheels in a direction of the longitudinal axis of the workpiece;

a work rest blade for supporting the workpiece, the work rest blade being arranged within a widening grinding gap which is formed by the regulating and grinding wheels so that, in relation to a reference plane which extends through the rotational axes of the grinding and regulating wheels, the longitudinal axis of the workpiece is always situated such that it is moved away from said reference plane within a part region of the grinding gap between the reference plane and a supporting face of the work rest blade; and wherein each of the regulating and grinding wheels is situated at a lateral spacing from its adjacently arranged wheel; and the regulating and grinding wheels are arranged such that they are offset in the axial direction with respect to one another; and the regulating wheels project into axial intermediate spaces between the grinding wheels and the grinding wheel project into axial intermediate spaces between the regulating wheels.

2. The grinding machine as claimed in claim 1, wherein the sets of regulating wheels and of grinding wheels consist of one set of grinding wheels and one set of regulating wheels.

3. The grinding machine as claimed in claim 2, further comprising:

respective rotationally; driven spindles on each of which respective sets of grinding wheels and regulating wheels are fixed; and a device is for each set effecting common radial setting movement of all the wheels of one set independently of the radial setting movement of another set; and wherein the regulating wheels and grinding wheels have diameters which increase in a stepped manner in an axial throughfeed direction of the workpiece in accordance with the grinding progress; and the work rest blade is adapted with respect to its supporting face to the diameter of the workpiece, which diameter decreases in the direction of the longitudinal axis of the workpiece.

4. The cylindrical grinding machine as claimed in claim 1, wherein lateral overlap regions of the regulating and grinding wheels are separated from one another by axial gaps the width of which is only so great that the regulating and grinding wheels do not mutually impair their function or even make contact, even during continuous production operation.

5. The grinding machine as claimed in claim 1, wherein axial width of the grinding wheels is smaller than axial width of the regulating wheels.

6. The grinding machine as claimed in claim 1, wherein the grinding wheels are galvanically coated CBN grinding wheels.

7. The cylindrical grinding machine as claimed in claim 1, wherein the grinding wheels are ceramically bonded CBN grinding wheels.

8. The grinding machine as claimed in claim 1, wherein the grinding wheels are metal-bonded CBN grinding wheels.

9. The grinding machine as claimed in claim 1, wherein the regulating wheels comprise steel.

10. The grinding machine as claimed in claim 9, wherein, on their outer circumference, the regulating wheels are provided with a thread profile which acts like a conveying worm to exert an axial thrust on the workpiece in a direction of a throughfeed direction.

11. The grinding machine as claimed in claim 9, wherein an outer circumference of the regulating wheel is configured as a friction lining by being formed by a different material than steel.

12. The grinding machine as claimed in claim 11, wherein the friction lining is a galvanically bound CBN layer.

13. The grinding machine as claimed in claim 3, further comprising an inlet support wheel having an elastic circumferential covering and being arranged at an inlet of, and in front of, a set of the regulating wheels, the inlet support wheel being fastened on the regulating wheel spindle.

14. The grinding machine as claimed in claim 3, further comprising a steel outlet support wheel mounted freely rotatably on the grinding wheel spindle at an outlet of, and behind a set of the grinding wheels.

15. The grinding machine as claimed in claim 1, further comprising a device for precentering the workpiece, the device being arranged in front of the sets of rolls and comprising a supporting prism and, operatively associated therewith, a pressure roller.

16. The grinding machine as claimed in claim 1, further comprising a device at a start of a workpiece movement path, the device imparting a forward thrust and movement to the workpiece in a direction of the longitudinal axis of the workpiece.

17. A method for the centerless cylindrical grinding of workpieces in rod form with a cylindrical outer contour using the throughfeed grinding process, the method comprising:

imparting to the rod-shaped workpiece movement in a direction of its longitudinal axis to run the workpiece through a widening grinding gap which is formed by at least one set of rotating regulating wheels and at least one set of rotating grinding wheels and by a work rest blade; and fixing a position of the workpiece in a radial direction in the widening grinding gap according to a reference plane through rotational and drive axes of the regulating and grinding wheels, the workpiece longitudinal axis being situated such that it is moved away from said reference plane within a part region of the grinding gap between the reference plane and a supporting face of the work rest blade; and wherein regulating wheels of the set of regulating wheels are situated at axial spacings from one another on a spindle which extends parallel to the longitudinal axis of the workpiece and set the workpiece in rotation;

the grinding wheels of the set of grinding wheels are arranged at axial spacings from one another on another spindle which extends parallel to the longitudinal axis of the workpiece, and grind the workpiece; and the regulating and grinding wheels are arranged such that they are offset in the axial direction with respect to one another and are adjacent in the radial direction so closely that the regulating wheels project into the axial spaces between the grinding wheels and the grinding wheels project into the axial spaces between the regulating wheels; and the regulating wheels and grinding wheels have diameters which increase in a stepped manner in a throughfeed direction of the workpiece and the work rest blade is adapted with its supporting face to the diameter of the workpiece, which diameter decreases in the direction of the longitudinal axis of the workpiece.

18. The grinding machine as claimed in claim 10, wherein the thread profile is configured as a friction lining by being formed by a different material than steel.

19. The grinding machine as claimed in claim 18, wherein the friction lining is a galvanically bound CBN layer.

20. The method for the centerless cylindrical grinding as claimed in claim 17, wherein a movement direction of a circumference the grinding wheel, at a point of contact of the grinding wheel circumference with the workpiece, extends in a direction of the reference plane.

* * * * *